US006369384B1

(12) United States Patent
Yefchak

(10) Patent No.: US 6,369,384 B1
(45) Date of Patent: Apr. 9, 2002

(54) TIME-OF-FLIGHT MASS SPECTROMETER WITH POST-DEFLECTOR FILTER ASSEMBLY

(75) Inventor: George E. Yefchak, Santa Clara, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 09/339,261

(22) Filed: Jun. 23, 1999

(51) Int. Cl.[7] ..... H01J 49/40; H01J 49/22

(52) U.S. Cl. ..... 250/287; 250/281; 250/282; 250/283; 250/294; 250/396 R

(58) Field of Search ..... 250/287, 281, 250/282, 283, 294, 396 R

(56) References Cited

U.S. PATENT DOCUMENTS

| | | | | |
|---|---|---|---|---|
| 5,654,544 A | | 8/1997 | Dresch | 250/287 |
| 5,658,413 A | | 8/1997 | Kaltenbach et al. | 156/272.8 |
| 5,696,375 A | * | 12/1997 | Park et al. | 250/287 |
| 5,753,909 A | | 5/1998 | Park et al. | 250/287 |
| 5,821,534 A | * | 10/1998 | Park | 250/287 |
| 5,847,385 A | | 12/1998 | Dresch | 250/287 |
| 5,986,258 A | * | 11/1999 | Park | 250/287 |

OTHER PUBLICATIONS

Yefchak, G.E., et al., "Beam Deflection for Temporal Encoding in Time–of–Flight Mass Spectrometry," American Society for Mass Spectrometry, 1990, pp. 440–447.

* cited by examiner

*Primary Examiner*—Bruce Anderson
*Assistant Examiner*—Nikita Wells

(57) ABSTRACT

A time-of-flight mass spectrometer includes a deflector and a filter assembly that is located along a flight path between the deflector and an ion detector. The filter assembly passes incoming ions to the detector when the ions approach the filter assembly along their original flight path, and the filter assembly occludes incoming ions from the detector when the ions have been deflected from their original flight path by the deflector. In an embodiment, the filter assembly includes filtering plates that are aligned such that the major surfaces of the filtering plates are parallel to the original flight path of the ions. In order to remove ions of a particular mass from a mass spectrum of ions, target ions are deflected from their original flight path, causing the target ions to impact the filtering plates while the ions that are not deflected from their original flight path pass between the filtering plates for measurement by the detector.

17 Claims, 11 Drawing Sheets

TIME-OF-FLIGHT MASS SPECTROMETER WITH POST-DEFLECTOR FILTER ASSEMBLY

TECHNICAL FIELD

The invention relates to time-of-flight mass spectrometry (TOFMS), and more particularly to a system that limits the detection of undesired ions.

BACKGROUND ART

In TOFMS, ions of different mass travel at different velocities along a flight path, creating a mass spectrum of ions. As a result of the different travel velocities, the ions in the mass spectrum strike a detector at the end of the flight path with a time distribution that enables the mass spectrum to be determined.

In TOFMS, it is often desirable to remove ions having a certain mass from the mass spectrum before the ions contact a detector. For example, it may be desirable to remove ions of a certain mass from the mass spectrum because the quantity of those ions is orders of magnitude higher than the ions of interest, or because the removed ions are from a known material that is of no interest to the analysis.

One known technique for removing undesired ions from a mass spectrum of ions involves ion deflection. Ion deflection is a technique in which a field of electrical potential is applied to a portion of a flight path at the moment that the target ions pass by the portion of the flight path that includes the electrical potential. The applied electrical potential causes the target ions to be deflected from the flight path such that the deflected ions do not impact a detector.

FIG. 1 is a depiction of a system 10 for implementing TOFMS with ion deflection. The key components of the system include an ion generator 12, a flight tube 14, a deflector 16, and a detector 18. The ion generator generates ion pulses that travel down the flight tube toward the detector. By knowing the time of flight for a particular mass of ions, the deflector can be momentarily activated to deflect a target mass of ions from the original flight path and out of the path of the detector. It should be noted that neither FIG. 1 nor the figures that follow are drawn to scale.

One known technique for accomplishing ion deflection utilizes a plate deflector and another known technique utilizes an interleaved-comb deflector. FIG. 2 is a depiction of the plates 22 of a plate deflector and example flight paths 24 of deflected ions 20. With regard to the plate deflector, two plates are placed along a flight tube (not shown), with both of the plates being generally parallel to each other and to the flight tube. The two plates are spaced apart so that ions pass between the plates as the ions travel through the flight tube. An electrical potential is applied between the deflector plates just as undesired ions pass between the plates, causing the target ions to be deflected from their original flight path and into a flight path that does not include the detector.

FIG. 3 is a depiction of the wires 28 of an interleaved-comb deflector and example flight paths 30 of deflected ions 20. With regard to the interleaved-comb deflector, an array of parallel wires is placed generally perpendicular to the original flight path. Equal but opposite-polarity voltages are applied to alternating wires at the time that target ions pass the parallel wires. The applied potential creates an electrical field that deflects the ions from their original flight path as shown in the example of FIG. 3. Other known interleaved-comb deflectors may utilize a series of interleaved parallel plates instead of wires to deflect ions.

Whether utilizing the plate deflector technique or the interleaved-comb deflector technique, the distance with which ions are deflected from their original flight path is a function of both the field created by the deflector and the length of the flight path that remains after the deflector. For example, referring to FIG. 4, a strong deflection field and a large distance (L) between the deflector 34 and the detector 36 will create a large deflection (D) of the actual flight path 38 from the original flight path 40. The angle of deflection ($\theta$) will depend on the strength of the deflection field, as well as other factors.

In order to prevent undesired ions from contacting the detector, the undesired ions must be deflected onto a flight path that does not include the detector. If the electrical field created by the deflector is too low, the undesired ions will not be deflected far enough from the original flight path to avoid striking the detector. However, there are concerns related to employing high strength deflection fields. Higher fields have a greater susceptibility to transmission or coupling of voltage pulses into the detector. Moreover, the equipment required for creating the higher strength fields (e.g., power supplies) tends to be more expensive. As a result, there is a tension between the need to adequately deflect unwanted ions and the desire to employ small electrical fields. In view of the tension between providing adequate ion deflection while minimizing the size of the applied electrical field, what is needed is a method and system that can deflect undesired ions out of a spectrum of ions with a relatively low electrical field created by the deflector.

SUMMARY OF THE INVENTION

A time-of-flight mass spectrometer includes a deflector and a filter assembly that is located along a linear or non-linear flight path between the deflector and an ion detector. The filter assembly passes incoming ions along the flight path to the detector when the ions approach the filter assembly along their original flight path, and the filter assembly occludes incoming ions from the flight path when the ions have been deflected from their original flight path by the deflector. In an embodiment, the filter assembly includes filtering plates that are aligned such that the major surfaces of the filtering plates are parallel to the original flight path of the ions. In order to remove ions of a particular mass from a mass spectrum of ions, target ions are deflected from their original flight path to cause the target ions to impact the filtering plates, while the ions that are not deflected from their original flight path pass between the filtering plates for measurement by the detector.

A preferred time-of-flight mass spectrometer includes an ion generator, a flight tube, the deflector, the detector, and the filter assembly. The ion generator, the flight tube, the deflector, and the detector, are all conventional devices that are used in time-of-flight mass spectrometers. The deflector is preferably either a plate deflector or an interleaved-comb deflector.

The filter assembly, which is the focus of the invention, is located along the flight path of the ions between the deflector and the detector. In an embodiment, the filter assembly includes a series of parallel filtering plates that are aligned such that the major surfaces of the filtering plates are in parallel with the original flight path of the ions. The filtering plates are maintained at the same voltage throughout the analysis process. The filtering plates are preferably passive elements that are not electrically manipulated, which is in contrast to the deflector which includes active elements that are electrically manipulated to deflect the ions.

The filtering plates that form the filter assembly function to reduce the acceptance angle for ion detection, where the acceptance angle is defined as the largest angle of flight relative to the filtering plates which will still allow passage of ions through the plates. Ions that do not enter the filter assembly at an angle that is parallel, or nearly parallel, with the major surfaces of the filtering plates will likely contact a filtering plate and be occluded from the flight path. With the filtering plates in place, a smaller angle of deflection is sufficient to prevent deflected ions from being detected by the detector.

The time-of-flight mass spectrometer equipped with the filter assembly of the invention can be utilized to accomplish mass-specific filtering. In order to accomplish mass-specific filtering the deflector is activated to deflect ions of a particular mass when the ions of that particular mass pass the deflector. The ions that are deflected from the original flight path no longer travel in parallel with the major surfaces of the filtering plates and therefore are occluded from the deflector. The ions of the desired masses are not deflected by the deflector and because they continue to travel along their original flight path, they pass between the parallel filtering plates and are easily detected by the detector.

With the filtering plates in place, target ions can be occluded from the detector by deflecting ions from the original linear or non-linear flight path at a smaller angle, and consequently with a smaller electrical field, than would be required to completely bypass the detector. In contrast, prior art systems require that ions be deflected with a large enough electrical field that the ions bypass the detector.

DETAILED DESCRIPTION

Figure 5:
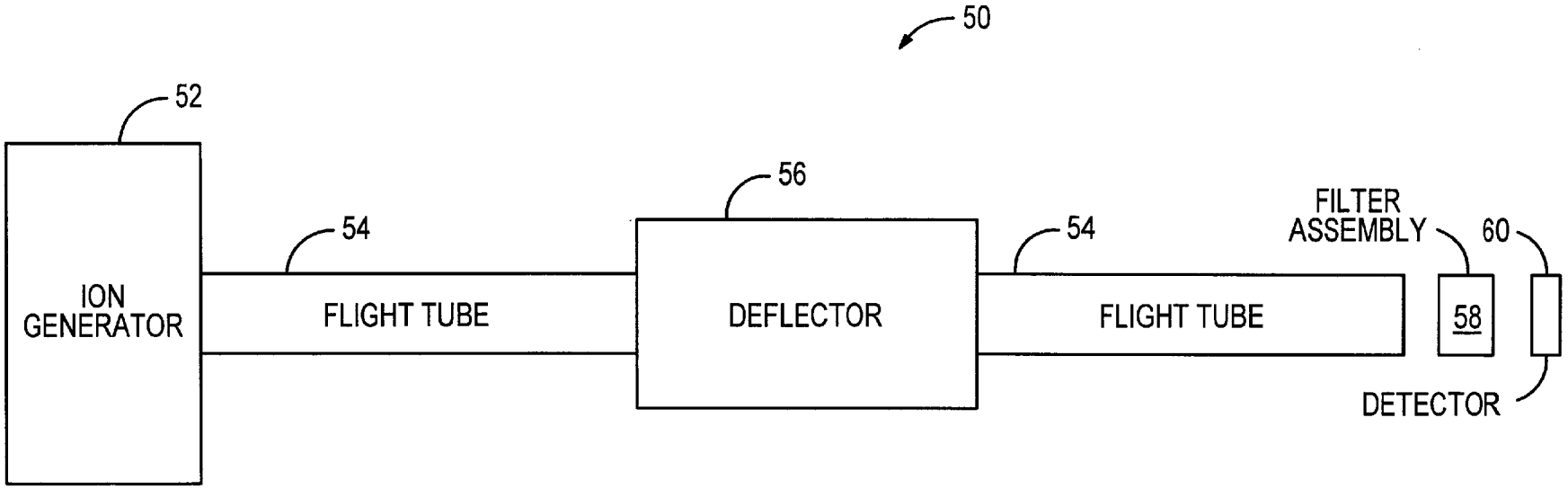
FIG. 5 is a depiction of a TOFMS that includes a filter assembly in accordance with the invention.

FIG. 5 is a depiction of a time-of-flight mass spectrometer (TOFMS) 50 that includes a filter assembly in accordance with the invention. The TOFMS of FIG. 5 includes an ion generator 52, a flight tube 54, a deflector 56, a detector 60, and the filter assembly 58. The ion generator is not critical to the invention and therefore the ion generator includes any device or system that can generate a pulse of ions and project the pulse of ions along a flight path. An example ion generator is an orthogonal acceleration ion generator, such as disclosed in U.S. Pat. No. 5,117,107 to Guilhaus et al.

The flight tube 54 is connected to receive ion pulses from the ion generator 52. The type of flight tube is not critical to the invention and therefore the flight tube includes any device or system that encloses the flight path of the ion pulses that are generated from the ion generator. Although commonly referred to as a tube, it is not necessary that the flight tube be tube shaped. The flight tube may be, for example, a flight channel having a square or rectangular cross section. In an example TOFMS, the flight tube may be on the order of 0.5 m long. It is not critical that the flight path remain linear from the ion generator 52 to the detector 60. For many TOFMS systems, one or more mirrors define a non-linear flight path. For example, as will be fully understood by a person skilled in the art, an MS/MS (mass spectrometry/ mass spectrometry) system will sometimes include two mirrors that establish a Z-shaped flight path. The deflector 56 and filter assembly 58 that will be described fully below can be positioned along any field-free segment of the non-linear flight path.

Figure 1:
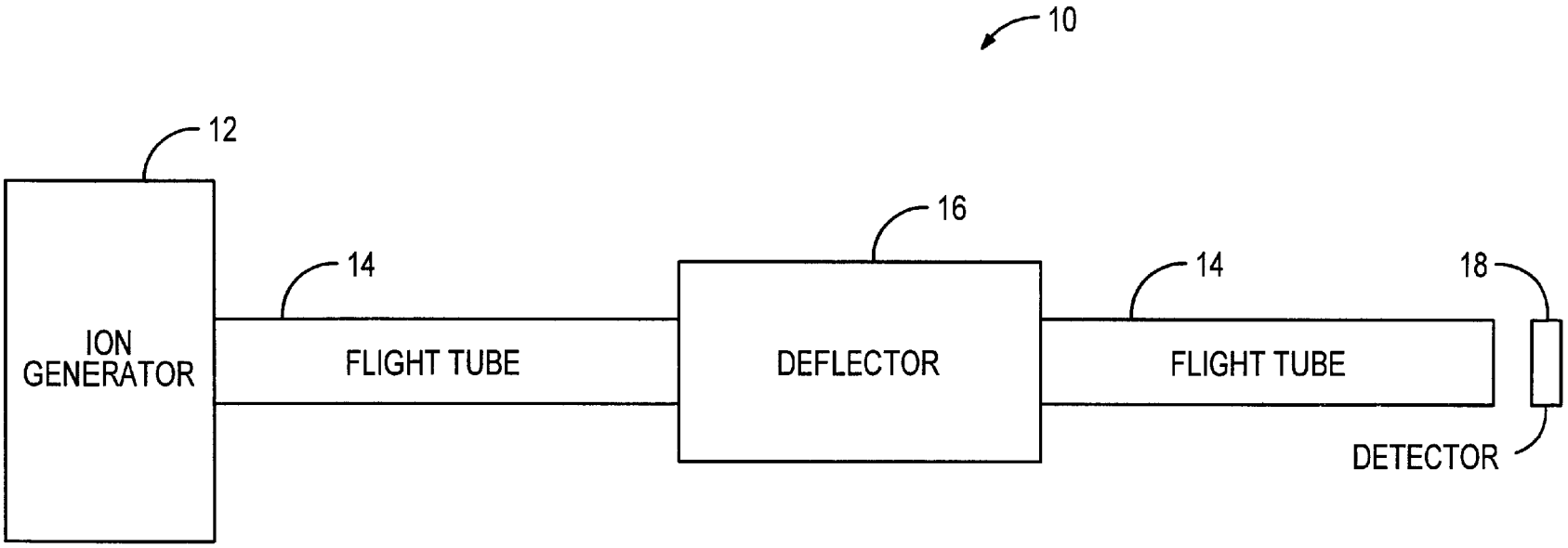
FIG. 1 (PRIOR ART)
FIG. 1 is a depiction of a system for implementing TOFMS with ion deflection in accordance with the prior art.
Figure 2:
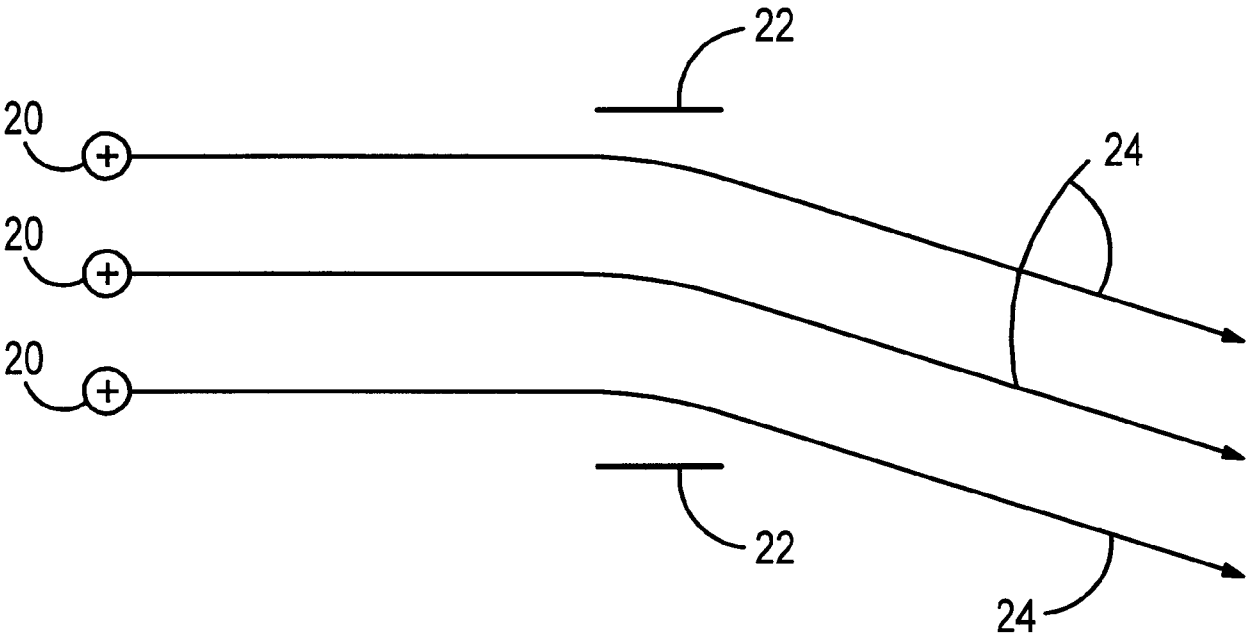
FIG. 2 (PRIOR ART)
FIG. 2 is a depiction of a plate deflector and example flight paths of deflected ions.
Figure 3:
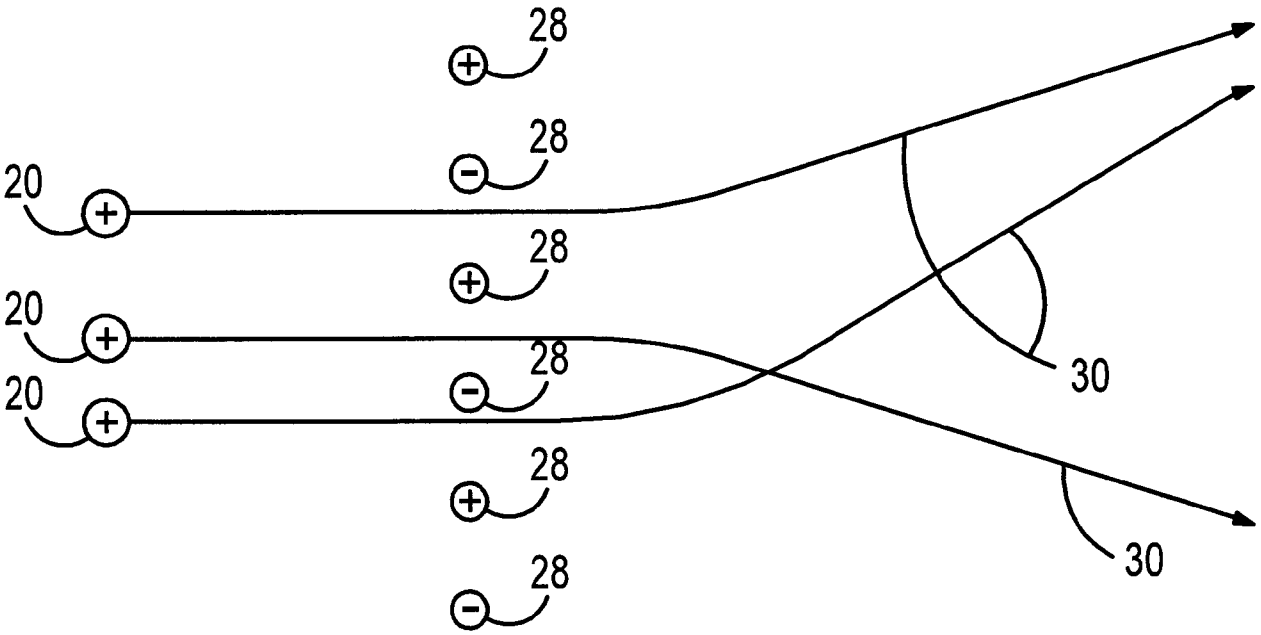
FIG. 3 (PRIOR ART)
FIG. 3 is a depiction of an interleaved-comb deflector and example flight paths of deflected ions.
Figure 4:
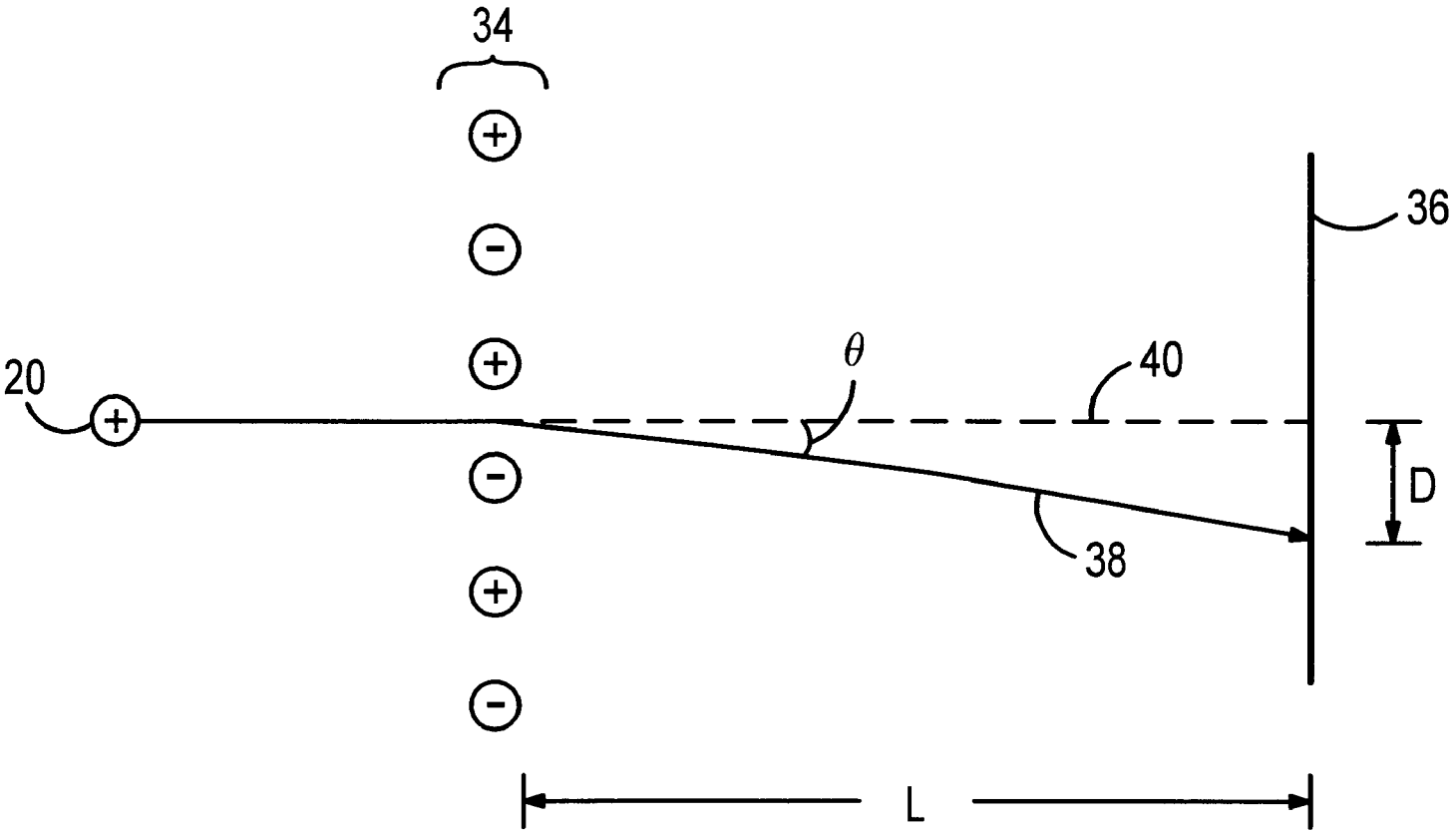
FIG. 4 is a depiction of an interleaved-comb deflector and an example flight path.

The deflector 56 is located along the flight tube 54 and functions to deflect ions from their original flight path by creating electrical fields within the flight tube. The deflector is preferably either a plate deflector or an interleaved-comb deflector as described with reference to FIGS. 2 and 3, however, other types of deflectors are possible. The deflector functions to deflect ions off of their original flight path by generating an electrical field when the voltage of the deflector is changed relative to the rest of the TOFMS system.

The detector 60 is located at the end of the flight tube 54 in general alignment with the flight tube. The type of detector is not critical to the invention and therefore the detector includes any device or system that measures the quantity of ions that impact the detector. In an example TOFMS, the detector may have a 1 cm×1 cm surface area.

Figure 6:
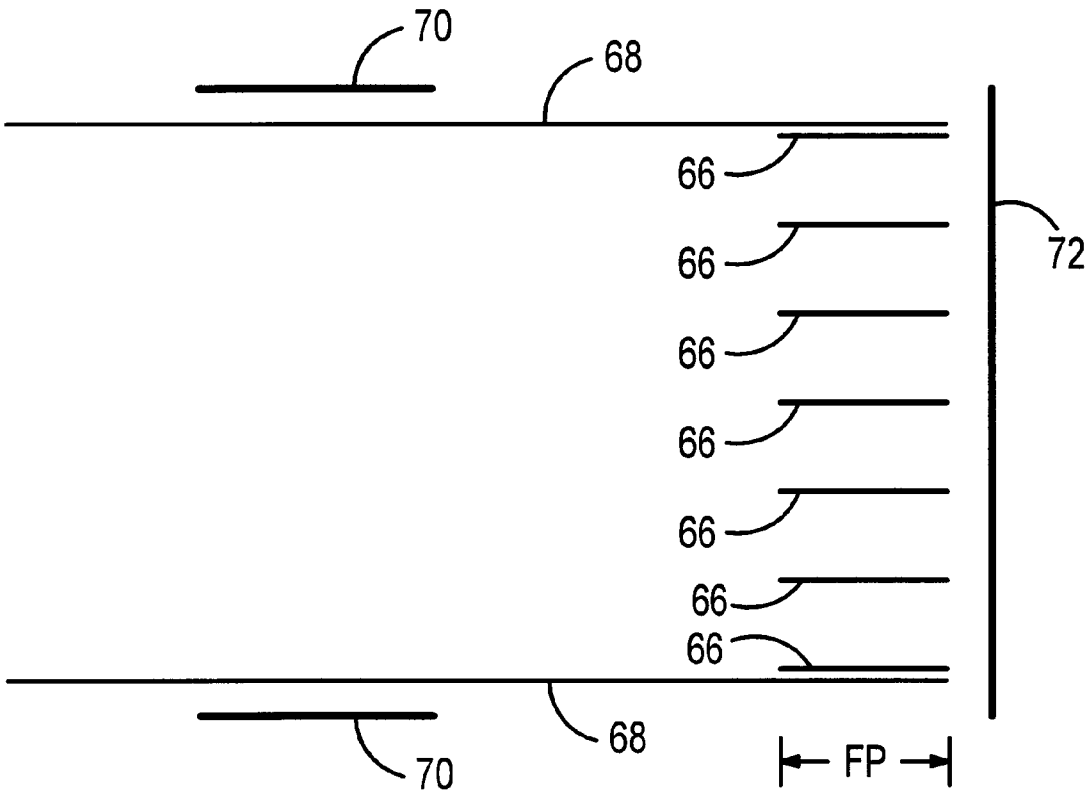
FIG. 6 depicts an example filter assembly relative to a flight tube, a plate deflector, and a detector.

The filter assembly 58, which is the focus of the invention, is located along the flight path between the deflector 56 and the detector 60. In a preferred embodiment, the filter assembly includes parallel filtering plates that are located near the detector and are aligned such that the major surfaces of the filtering plates are in parallel with the original flight path of the ion pulses. FIG. 6 depicts example filtering plates 66 of a filter assembly relative to a flight tube 68, a plate deflector 70, and a detector 72. FIG. 6 shows that the minor surfaces (as well as the major surfaces) of the filtering plates are preferably parallel to each other. Although the filtering plates are illustrated as being parallel to each other, the filter assembly can be implemented with filtering plates that are not parallel to each other. In an example TOFMS, each filtering plate may be 1 cm high×1 cm long×0.25 mm thick.

During operation, the filtering plates are maintained at the same voltage as the TOFMS system (e.g., ground). The filtering plates are preferably passive elements that are not electrically manipulated like the deflector plates, although there may be applications in which the voltage of the filtering plates is manipulated to enhance filtering.

The filtering plates that form the filter assembly function to reduce the acceptance angle for ion detection, where the acceptance angle is defined as the largest angle of flight, relative to the filtering plates, which will still allow passage of ions through the plates without the ions contacting any of the filtering plates. Specifically, ions that do not enter the filter assembly at an angle that is parallel, or nearly parallel, with the major surfaces of the filtering plates have a higher likelihood of contacting a filtering plate and being occluded from contacting the detector. With the filtering plates in place, a smaller angle of deflection (and therefore a smaller electrical field) is sufficient to cause deflected ions to contact a major surface of one of the plates, thereby preventing the ions from being detected by the detector.

In addition to the magnitude of deflection imparted on target ions, the degree of filtering achieved by the filter assembly is a function of the dimensions and spacing of the filtering plates. For example, referring again to FIG. 6, the acceptance angle for ion detection is reduced as the length (FP) of the filtering plates 66 is increased (assuming that the number and spacing of filtering plates remain constant). Likewise, the angle of acceptance is enlarged as the length (FP) of the filtering plates is decreased.

The angle of acceptance can also be manipulated by changing the number and spacing of the filtering plates 66. For example, the angle of acceptance is reduced as more filtering plates are spaced closer together, and conversely, the angle of acceptance is increased when fewer filtering plates are spaced further apart (assuming that the dimensions of the filtering plates remain constant). The exact spacing and dimensions of the filtering plates are a function of the particular application.

Figure 7:
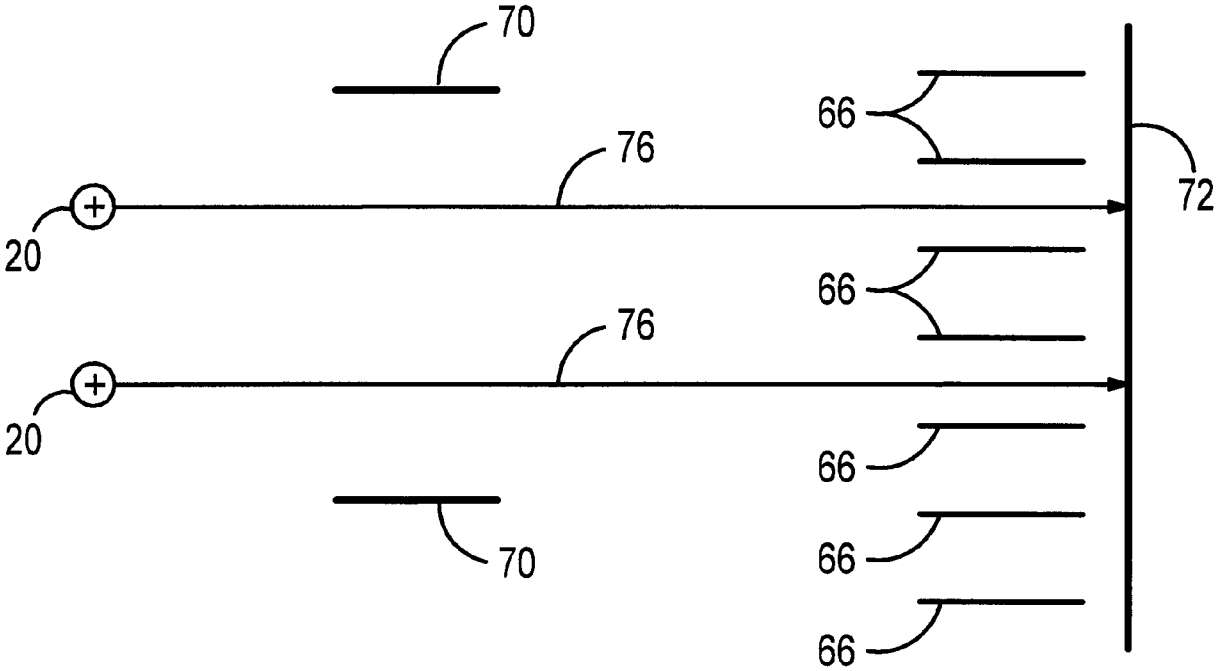
FIG. 7 depicts an example filter assembly in relation to ions that travel along their original flight path and in parallel with major surfaces of the filtering plates.
Figure 8:
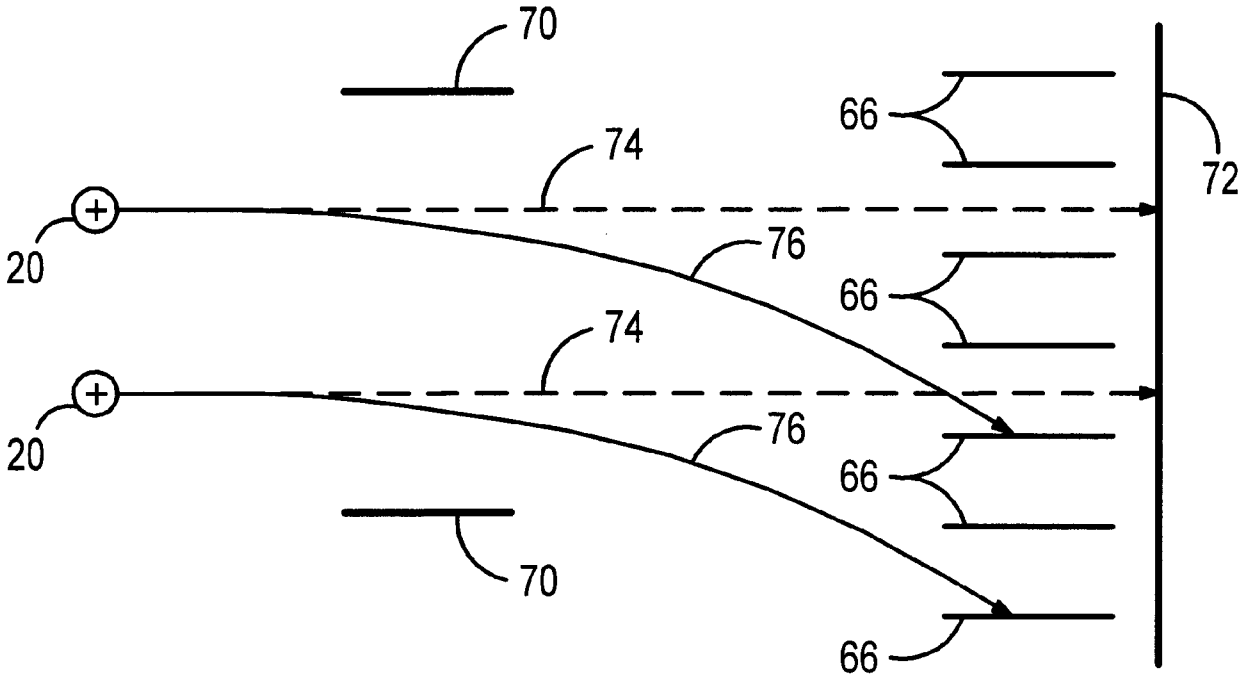
FIG. 8 depicts an example filter assembly in relation to ions that are deflected from their original flight path and are not traveling in parallel with the major surfaces of the filtering plates.
Figure 9:
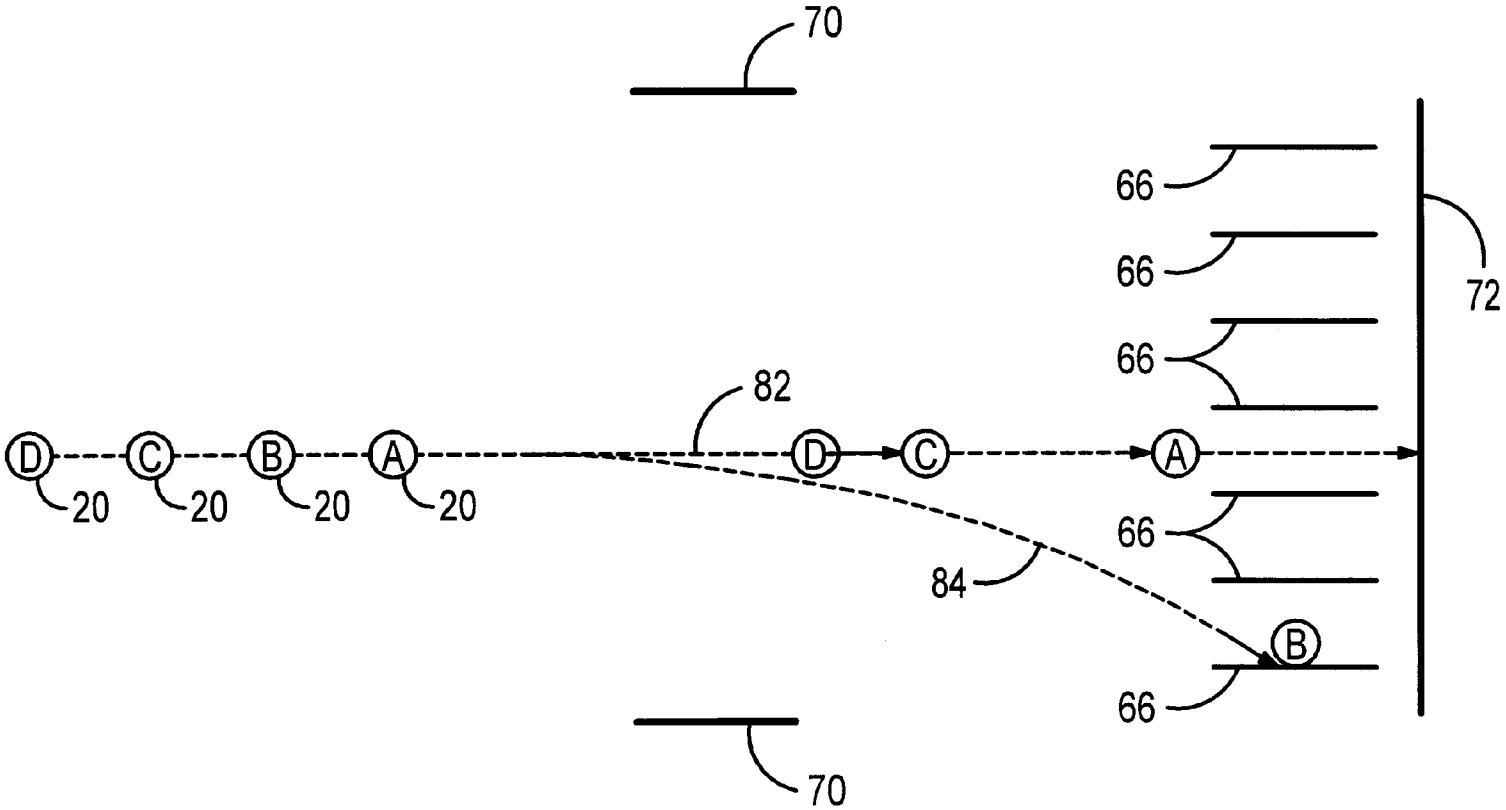
FIG. 9 depicts mass-specific filtering of ions utilizing the filter assembly in accordance with the invention.

FIGS. 7–9 illustrate an example operation of a TOFMS utilizing a filter assembly in accordance with the invention. FIG. 7 is a depiction of filtering plates 66 in relation to a plate deflector 70, the detector 72, and ions 20 that travel along their original linear flight path 76. As depicted, the ions are not deflected from their original flight path as they pass between the plate deflectors 70, and because the filtering plates 66 are in parallel with the original linear flight path 76, the ions pass through the filtering plates unobstructed by the filtering plates and contact the detector 72.

FIG. 8 is a depiction of the filtering plates 66 in relation to the plate deflector 70 and the detector 72 as shown in FIG. 7. As depicted, the ions 20 are deflected from their original flight path 74 and onto a deflected flight path 76 as they pass between the plate deflectors. Because the filtering plates are parallel with the original flight path and because the deflected ions are no longer traveling parallel with the original flight path, the deflected ions impact the major surfaces of the filtering plates and are prevented from reaching the detector. With the filtering plates in place, target ions can be occluded from the detector by deflecting ions from their original flight path at a smaller angle than would be required to completely bypass the detector. In contrast, prior art systems require that ions be deflected at a large enough angle that the ions bypass the detector. As described above, the filtering sensitivity of the filter assembly can be changed by adjusting the angle of deflection of the ions, the dimensions of the filtering plates, and/or the number and spacing of the filtering plates.

FIG. 9 is a depiction of how a TOFMS with the filter assembly of the invention is utilized to accomplish mass-specific filtering. As shown in FIG. 9, a pulse of ions 20 traveling in the flight tube separates by mass because of differences in the flight time for each mass of ions. In FIG. 9, different mass groupings of ions are represented as A, B, C and D, respectively. In the example, it is desired to remove the ions of mass B, referred to as the target ions, from the spectrum of ions that are traveling in the flight tube.

According to FIG. 9, the ions 20 of mass A pass through the deflector first. No charge is applied to the deflector plates 70 during the time that the ions of mass A pass between the deflector plates and as a result, the ions of mass A remain on their original flight path 82. The ions of mass A pass through the filtering plates 66 and impact the detector 72. Ions of mass B pass through the deflector next. A charge is applied to the deflector plates during the time that the ions of mass B pass between the deflector plates and as a result, ions of mass B are deflected off of their original flight path onto a deflected flight path 84. The deflected ions of mass B contact major surfaces of the filtering plates and do not contact the detector. The ions of mass C pass through the deflector next. No charge is applied to the deflector plates during the time that the ions of mass C pass between the deflector plates and as a result, the ions of mass C remain on their original flight path. The ions of mass C pass through the filtering plates and impact the detector. The ions of mass D pass through the deflector next. No charge is applied to the deflector during the time that the ions of mass D pass between the deflector plates and as a result, the ions of mass D remain on their original flight path. The ions of mass D pass through the filtering plates and impact the detector.

By synchronizing the deflection of ions with the passing of a target mass, the ions of a target mass (e.g.,mass B) can be deflected off of their original flight path 82, causing the undesired ions to impact the filtering plates 66 and preventing the deflected ions from being measured by the detector 72. Because the filtering plates reduce the angle of acceptance for ions, a slight change in the flight path causes the deflected ions to contact the filtering plates.

Figure 10:
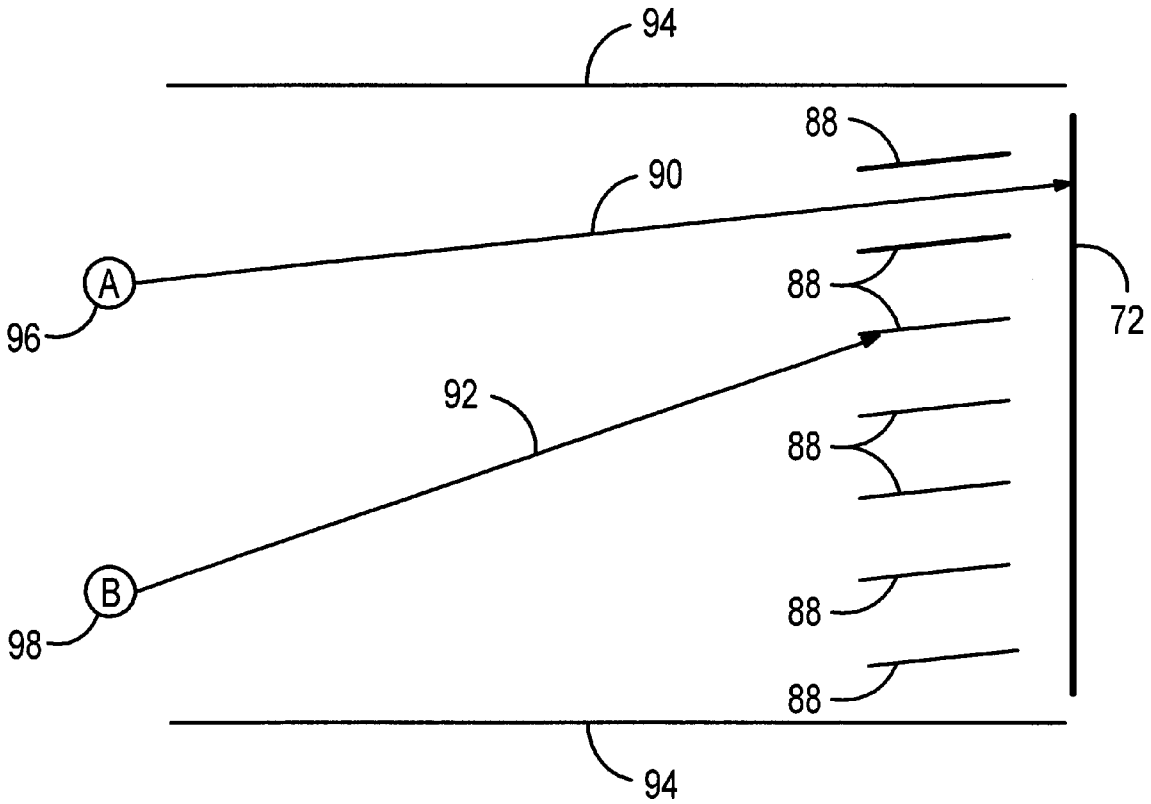
FIG. 10 depicts a filter assembly having filtering plates that are angled to be in parallel with the original flight path of ions in accordance with the invention.

FIG. 10 is a depiction of a filter assembly in which the angle of the filtering plates 88 has been slightly changed to correspond to the original flight path 90 of the ion pulse. In some TOFMSs the ion pulses travel along flight paths that are not parallel to the flight tube 94. In order to pass undeflected ions 96 and occlude deflected ions 98, the angle of the filtering plates is adjusted to be in parallel with the original flight path 90 of the ion pulses. As shown in FIG. 10, the ions of mass A have an original flight path that is not parallel to the flight tube. The angle of the filtering plates has been adjusted to be generally parallel with the original flight path of the mass A ions. The mass B ions have a deflected flight path 92, similar to the mass B ions of FIG. 9, and as a result they are filtered out of the detected ion stream. Because the ions of mass B have been deflected from their original flight path, they are no longer traveling in parallel with the filtering plates. Because the ions of mass B are no longer traveling in parallel with the filtering plates, they contact major surfaces of the filtering plates and are occluded from the detector.

In addition to occluding deflected ions, the filtering plates may also occlude other undesired ions. For example, ions that "leak" out of the ion generator or other regions within the TOFMS may have a sufficient angle of trajectory that they are occluded by the filtering plates in the same manner as the deflected ions.

Figure 11:
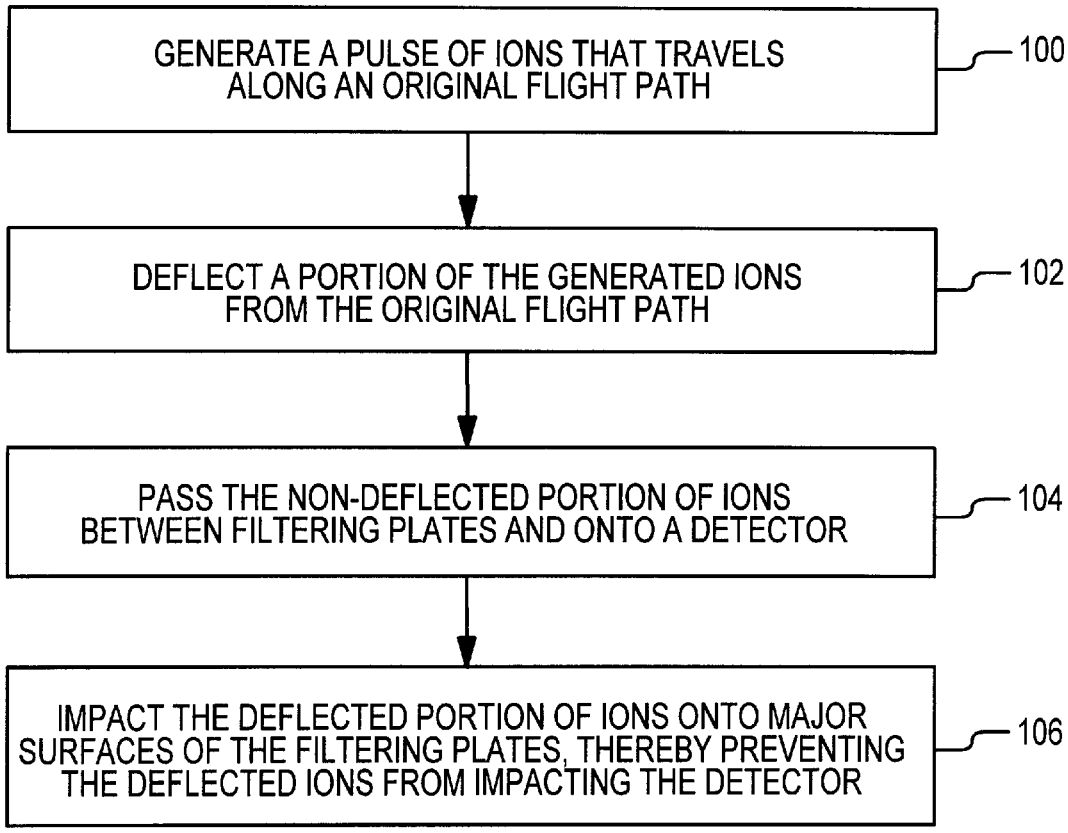
FIG. 11 is a process flow diagram that represents a preferred mass-specific filtering method in accordance with the invention.

FIG. 11 is a process flow diagram that represents a preferred method of the invention. In a first step 100, a pulse of ions that travels along an original flight path is generated. In a step 102, a portion of the generated ions are deflected from the original flight path. In a step 104, the non-deflected portions of the ions pass between the filtering plates and contact a detector. In a step 106, the deflected portions of the ions impact onto major surfaces of the filtering plates, thereby preventing the deflected ions from impacting the detector.

What is claimed is:

1. A time-of-flight mass spectrometer comprising:

an ion generator for generating a pulse of ions;

an intended flight path, operatively associated with said ion generator, along which said ions travel;

a deflector for deflecting selected ions of said pulse traveling along said intended flight path, while enabling remaining ions of said pulse to travel past said deflector and along said intended flight path;

a detector located at an end of said intended flight path opposite to said ion generator, said detector detecting ions that impact said detector; and a filtering means, located in a region along said intended flight path between said deflector and said detector, for passing ions that approach said filtering means along said intended flight path and occluding said selected ions that have been deflected from said intended flight path by said deflector, said filtering means being structurally independent of said deflector for deflecting said selected ions of said pulse.

2. The time-of-flight mass spectrometer of claim 1 wherein said means for passing and occluding includes filtering plates that are aligned such that major surfaces of said filtering plates are parallel to said intended flight path through said region in which said means is located.

3. The time-of-flight mass spectrometer of claim 1 wherein said means for passing and occluding includes filtering plates that are aligned such that major surfaces of said filtering plates are parallel to each other.

4. The time-of-flight mass spectrometer of claim 1 wherein said means for passing and occluding includes filtering plates that are aligned such that major surfaces of said filtering plates are parallel to said intended flight path.

5. The time-of-flight mass spectrometer of claim 2 wherein said filtering plates are at the same voltage as a flight channel that defines at least a portion of said intended flight path.

6. The time-of-flight mass spectrometer of claim 5 wherein said filtering plates have voltages that remain constant during spectrum analysis.

7. The time-of-flight mass spectrometer of claim 5 wherein said flight channel is generally parallel to said intended flight path.

8. The time-of-flight mass spectrometer of claim 2 wherein said filtering plates are separate and distinct from said deflector.

9. A method of eliminating ions of a particular mass from a pulse of ions in a time-of-flight mass spectrometer so that said eliminated ions are not detected comprising the steps of:

generating a pulse of ions that travel along a selected flight path;

deflecting a portion of said pulse of ions from said flight path, thereby creating a deflected portion of said pulse of ions that travel along a deflected flight path and a non-deflected portion of said pulse ions that travel along said flight path;

passing said non-deflected portion of said pulse of ions between filtering plates having major surfaces that are aligned generally in parallel with said flight path, said filtering plates located between a deflector and an ion detector; and impacting said deflected portion of said pulse of ions onto said major surfaces of said filtering plates that are aligned generally in parallel with said flight path.

10. The method of claim 9 further including a step of maintaining said filtering plates at a constant voltage throughout said steps of generating, deflecting, passing, and impacting.

11. The method of claim 9 wherein said flight path is linear.

12. The method of claim 9 wherein said step of deflecting includes a step of synchronizing said deflecting such that an unwanted portion of said pulse of ions is deflected off said flight path.

13. An ion deflection arrangement in a time-of-flight mass spectrometer comprising:

deflector means positioned along a flight path of said mass spectrometer for deflecting a first group of ions from said flight path while a second group of ions is substantially unaffected by said deflector means; and a filter assembly having a plurality of filtering plates, said filter assembly being positioned along said flight path such that said second group of ions passes between said filtering plates and said first group of ions is deflected by said deflector means to impinge said filtering plates.

14. The ion deflection arrangement of claim 13 wherein said major surfaces of said filter plates are generally parallel to an original flight path that is defined by a source of said ions.

15. The ion deflection arrangement of claim 14 wherein said filtering plates are spaced apart from each other and have dimensions such that ions of said first group that are deflected from said original flight path by said deflector means impact at least one of said filtering plates.

16. The ion deflection arrangement of claim 13 wherein said filtering plates are distinct from said deflector means and wherein said filtering plates are maintained at a constant electrical potential.

17. The ion deflection arrangement of claim 13 wherein said filtering plates are passive elements.

* * * * *